United States Patent [19]

Iida et al.

[11] Patent Number: 4,717,134

[45] Date of Patent: Jan. 5, 1988

[54] SHEET FOLDING APPARATUS

[75] Inventors: Noriyoshi Iida, Ichikawa; Nobutaka Uto, Yokohama; Masakazu Hiroi, Tokyo; Akimitsu Hoshi, Yokohama, all of Japan

[73] Assignee: Canon Kabushiki Kaisha, Tokyo, Japan

[21] Appl. No.: 839,605

[22] Filed: Mar. 14, 1986

[30] Foreign Application Priority Data

| | | | |
|---|---|---|---|
| Mar. 15, 1985 | [JP] | Japan | 60-052055 |
| Mar. 20, 1985 | [JP] | Japan | 60-057140 |
| Apr. 19, 1985 | [JP] | Japan | 60-085089 |

[51] Int. Cl.[4] ..... B41L 1/32

[52] U.S. Cl. ..... 270/39; 493/421; 270/45

[58] Field of Search ..... 270/39, 45; 493/419–421, 405, 414, 417, 424

[56] References Cited

U.S. PATENT DOCUMENTS

| | | | |
|---|---|---|---|
| 3,265,382 | 9/1966 | Sherman | 270/45 |
| 4,621,966 | 11/1986 | Lupertl et al. | 493/421 |

FOREIGN PATENT DOCUMENTS

| | | | |
|---|---|---|---|
| 561902 | 10/1932 | Fed. Rep. of Germany | 493/421 |
| 2110964 | 12/1971 | Fed. Rep. of Germany | 493/421 |
| 2253574 | 5/1974 | Fed. Rep. of Germany | 493/421 |
| 290590 | 12/1928 | United Kingdom | 493/421 |
| 361787 | 11/1931 | United Kingdom | 493/420 |
| 2069981 | 9/1981 | United Kingdom | 493/421 |

*Primary Examiner*—E. H. Eickholt

*Attorney, Agent, or Firm*—Fitzpatrick, Cella, Harper & Scinto

[57] ABSTRACT

A sheet folding apparatus including a plurality of sheet processing units each having a couple of folding rollers, a deflector and a folding position controlling passage. One set of the apparatus is sufficient to effect two-folding, z-folding and reversed z-folding of the sheet. A guiding member is disposed closely adjacent to the nip of the folding roller couple for conveying the sheet out of the folding positions controlling passage and for forming a new fold. When the sheet is three-folded, an undesirable double fold is prevented, which may otherwise be produced by an undesirable fold formed adjacent to the already formed fold when the sheet is folded second time.

8 Claims, 15 Drawing Figures

SHEET FOLDING APPARATUS

FIELD OF THE INVENTION AND RELATED ART

The present invention relates to a sheet folding apparatus for folding a sheet delivered from an image forming apparatus such as a copying machine and a printing machine, more particularly, to a sheet folding apparatus wherein a sheet can be folded in three in a "Z" or a reversed "Z" folding. Conventionally, in order to fold a sheet in two, in order to fold in Z-fashion or in order to fold in a reversed Z-fashion, an independent machine exclusively for desired one of the manners of the folding desired is coupled to the image forming apparatus such as a copying machine or printing machine. Therefore, it is necessary for the operator to interchange the folding machines depending on the desired folding fashion, which has been inconvenient.

FIG. 7 illustrates an example of a conventional sheet folding apparatus usable for folding in three, that is, in a Z-fashion or a reversed Z-fashion. In this apparatus, plural couples of rollers 20, 21 and 29 are disposed in a sheet passage 27, and a stopper 30 for stopping the sheet is provided in the sheet passage. In order to fold the sheet in the Z-fashion, a leading edge of the sheet S is stopped by an unshown stopper, so that a loop is formed at a position corresponding to one fourth of the sheet. The formed loop of the sheet S is gripped by a nip of a first couple of rollers (not shown) so that a first fold A is formed at the one fourth position. The sheet S, then, is conveyed so that first fold A which is now the leading edges of the sheet S is stopped by the stopper 30. By this, a loop B is formed at a position corresponding to the edge of the sheet S. Then, the loop B and the edge C of the sheet S are gripped by a second couple of rollers 21 and 29, so that a second fold is formed, and the sheet S is folded in the z-fashion.

When the edge C and the loop B of the sheet S are gripped by the second couple of rollers 21 and 29, the sheet S is folded in three and conveyed. Therefore, the topmost sheet surface D is conveyed by the rotation of the roller 29, while the bottommost sheet surface F is conveyed by the roller 21. The intermediate part of the sheet E is conveyed by the force transmitted from the roller 21 and the roller 29 by way of the sheet surface D and the sheet surface F. However, when the sheet is conveyed by the second folding roller couple (21, 29), there may be a disadvantage that a slip occurs between the intermediate sheet surface E and the topmost sheet surface D having the edge C of the sheet S, with the result that the linear conveying speed of the intermediate sheet part E is lower than that of the topmost sheet surface D. If this occurs, when the first fold A is gripped by the second folding roller couple (21, 29), a slack can occur at the intermediate sheet surface E. Then, the slack is gripped by the roller couple (21, 29), the first fold A is duplicated, that is, two folds are formed where there should be one.

SUMMARY OF THE INVENTION

Accordingly, it is a principal object of the present invention to provide a sheet folding apparatus wherein the sheet can be transported without being subjected to a folding process, while the sheet can be subjected to two-folding, z-folding or a reversed z-folding process.

It is another object of the present invention to provide a sheet folding apparatus which can fold the sheet in three, for example, in the z-fashion or a reversed z-fashion, wherein the occurrence of double fold formation, that is, an additional fold is formed in the neighborhood of the already formed fold, is effectively prevented.

These and other objects, features and advantages of the present invention will become more apparent upon a consideration of the following description of the preferred embodiments of the present invention taken in conjunction with the accompanying drawings. dr

DETAILED DESCRIPTION OF THE PREFERRED EMBODIMENTS

Figure 1:
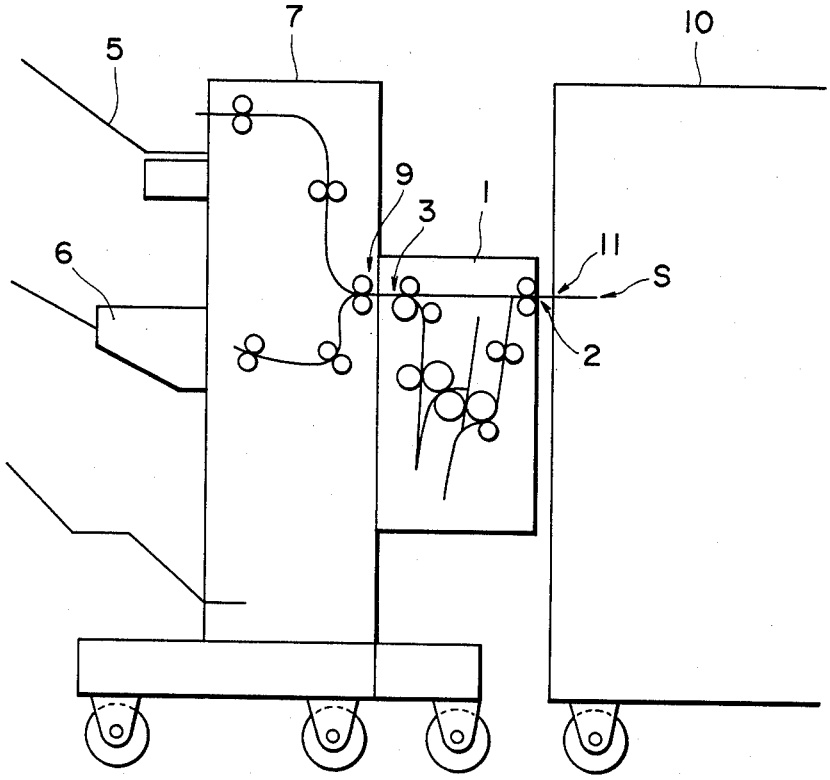
FIG. 1 is a sectional view of a sheet folding apparatus according to an embodiment of the present invention, which is used with an image forming apparatus together with a finisher apparatus.

Referring to FIG. 1, there is shown a sheet folding apparatus according to an embodiment of the present invention, which is coupled to a copying apparatus 10 together with a finisher apparatus 7. A sheet discharging outlet 3 of the sheet folding apparatus 1 is aligned with the sheet receiving inlet 9 of the finisher apparatus 7, while the sheet discharging outlet 11 of the copying apparatus 10 is aligned with the sheet receiving inlet 2 of the folding apparatus 1.

Figure 2:
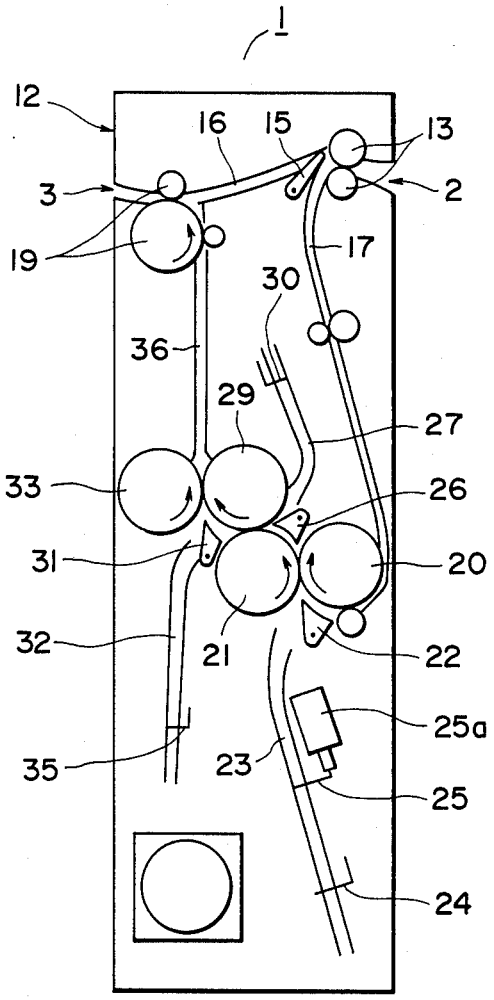
FIG. 2 is a sectional view of a sheet folding apparatus according to the embodiment of the present invention.

As shown in FIG. 2, the sheet receiving inlet 2 of the sheet folding apparatus 1 is disposed at an upper portion of the frame 12 of the sheet folding apparatus. At the inlet 2, there is provided a receiving couple of rollers 13 and 13. At a downstream portion of the receiving couple of rollers 13 and 13 with respect to the direction of transportation of the sheet, there is an inlet deflector 15 to switch the transportation of the sheet in two directions, more particularly, selectively to a sheet passing passage 16 or to a sheet folding passage 17. At a position downstream of the sheet passing passage 16, there is a discharging couple of rollers 19 and 19, which is effective to discharge the sheet S through the downstream discharging outlet 3. The sheet discharging outlet 3 is at substantially the same level of the sheet receiving inlet 2.

A first folding roller 21 is disposed downstream of the folding passage 17. Contacted to the first folding roller 20 is a second folding roller 21. Those rollers are rotatable in the direction indicated by arrows. Downstream of the first folding roller 20, a first deflector 22 is provided in order to switch the sheet passage, whereby the sheet S received from the folding passage 17 is selectively conveyed to a first folding position controlling passage 23 or two a first stage folding roller couple (20, 21) constituted by the first and second folding rollers 20 and 21.

Downstream of the first folding position controlling passage 23, there are disposed a fixed stopper 24 and a movable stopper 25 which is driven by a solenoid 25*a* in the manner that the movable stopper 25 goes into the passage 23 when the solenoid 25*a* is energized. A second deflector 26 is disposed downstream of the first stage folding roller couple (20, 21) and is effective to switch the sheet transportation. More particularly, it can direct the sheet S conveyed from the first stage folding roller couple (20, 21) selectively to a second folding position controlling passage 27 or to a second stage folding roller couple (21, 29) constituted by the second folding roller 21 and a third folding roller 29 contacted to the roller 21. And, downstream of the second folding position controlling passage 27, a fixed stopper 30 is provided.

Figure 6:
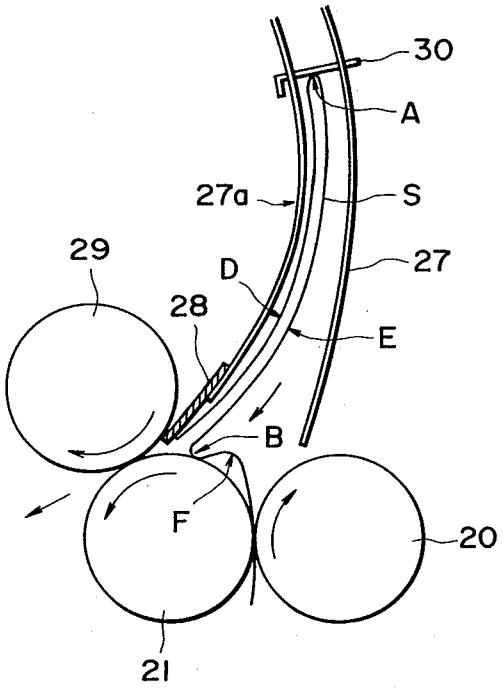
FIG. 6 illustrates a sheet folding mechanism according to the present invention.

As shown in FIG. 6, a guide member 28 is mounted to an upper passage plate 27*a* of the second folding position controlling passage 27 in the neighborhood of the nip formed between the second stage folding rollers 21 and 29. The guide member 28 is of an elastic material such as a Mylar sheet.

A third deflector 31 (FIG. 2) is disposed downstream of the second stage folding roller couple (21, 29). The third deflector 31 is effective to direct the sheet S in two directions selectively. More particularly, it allows the sheet S conveyed from the second stage folding roller couple (21, 29) to pass to a third folding position controlling passage 32 or to a third stage folding roller couple (29, 33) constituted by the third folding roller 29 and a fourth folding roller 33 contacted to the roller 29. And, downstream of the third folding position controlling passage 32, a fixed stopper 35 is mounted. Furthermore, downstream of the third stage folding roller couple (29, 33), there is an additional passage 36 for the sheet which finishes the folding operations. The downstream end of the passage 36 is opened to the discharging roller couple 19 and merges to the above-described sheet passing passage 16.

Figure 4:
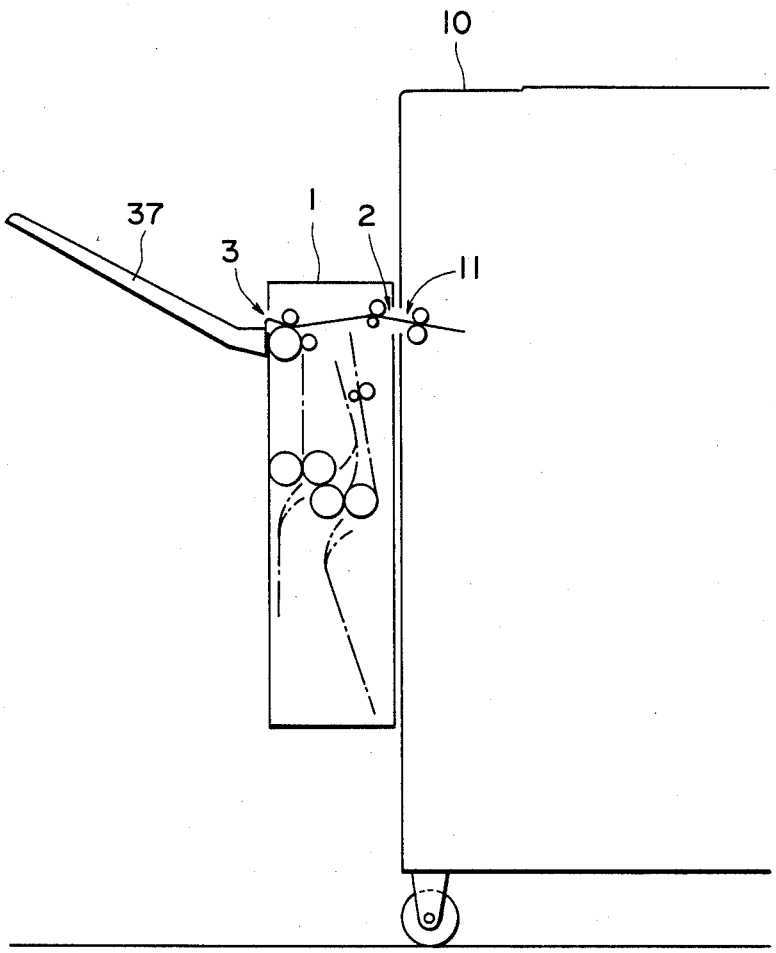
FIG. 4 is a sectional view of the sheet folding apparatus which alone is coupled to the image forming apparatus.

As shown in FIG. 4, a bin tray 37 can be detachably mounted to the sheet discharging outlet 3 of the sheet folding apparatus, and the sheet folding apparatus can be detachably attached to the copying apparatus 10 in the manner that the sheet receiving inlet 2 of the sheet folding apparatus 1 is aligned with the sheet discharging outlet 11 of the copying machine 10.

Figure 8:
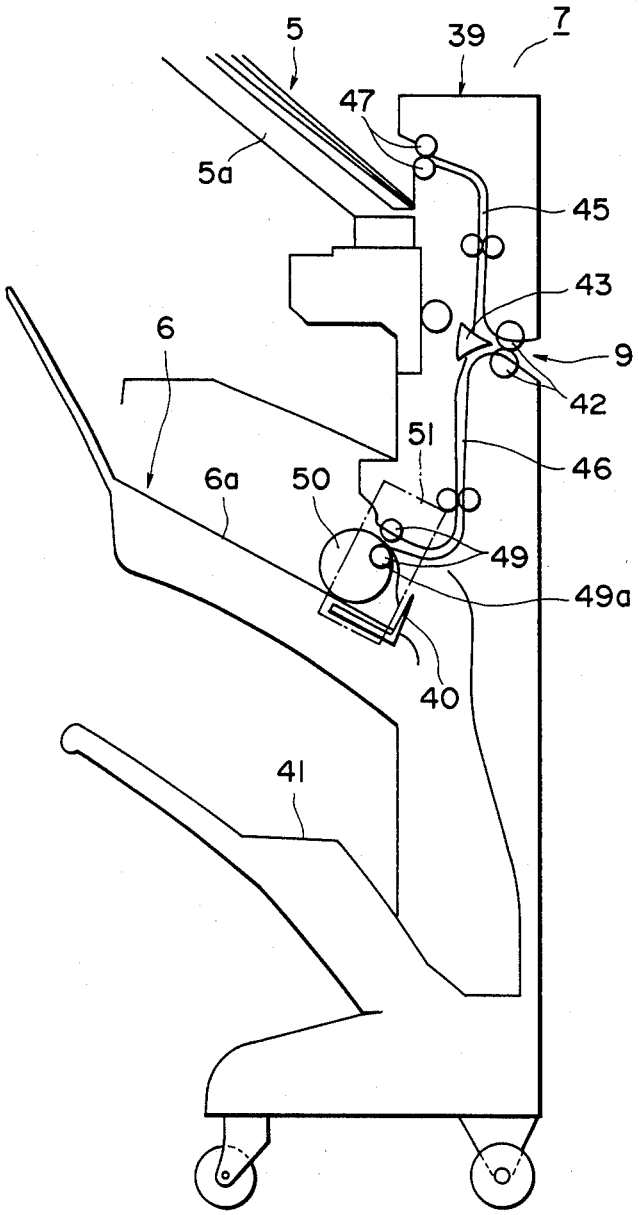
FIG. 8 is a sectional view of an example of a finisher apparatus.

As shown in FIG. 8, to the finisher apparatus 7, a sheet stacking tray 5*a* can be attached at a rear upper portion of the frame 37 of the apparatus. The sheet stacking tray 5*a* constitutes a stacker portion 5 reciprocable in horizontal and vertical directions. In the main frame 39 of the apparatus there is an intermediate tray 6*a* *below the stacker portion 5, the intermediate tray 6a* constituting a stapling portion 6. At a front end of the intermediate tray 6*a*, there is disposed a rotatable stopper 40 for supporting an edge of the sheet S on the tray 6*a*. Below the stapling portion 6 of the main frame 39, there is a lower tray 41 so that the sheet S which falls from the intermediate tray 6*a* when the stopper 40 pivots, is received on the lower tray 41. A sheet receiving inlet 9 is disposed in the front upper portion of the main frame 39 of the finisher apparatus at such a level which is substantially the same as the sheet discharging outlet of the copying apparatus 10. At the sheet inlet 9, a couple of receiving rollers 42 and 42 is disposed. Downstream of the roller couple 42, there is an inlet deflector 43 so as to selectively direct the sheet from the sheet inlet 9 to a passage 45 leading to the stacker portion or to a passage 46 leading to the stapling portion. At the downstream end of the stacker passage 45, a discharging roller couple 47 is provided so as to discharge the sheet S to the sheet stacking tray 5*a*. At the downstream end of the stapling portion passage 46, there is a discharging couple of rollers 49 and 49. Around a lower roller 49*a* of the discharging couple 49 of rollers, a part of a belt 50 contacted to the intermediate tray 6*a* is trained, so that the belt 50 rotates together with the lower roller 49*a* and the sheet S discharged onto the intermediate tray 6*a* is aligned along the stopper 40 at the edge thereof by the rotation of the discharging roller couple 49. Further, a stapler 51 is disposed above the lower part of the intermediate tray 6*a* and is effective to staple the sheets S on the intermediate tray 6*a*.

Figure 9:
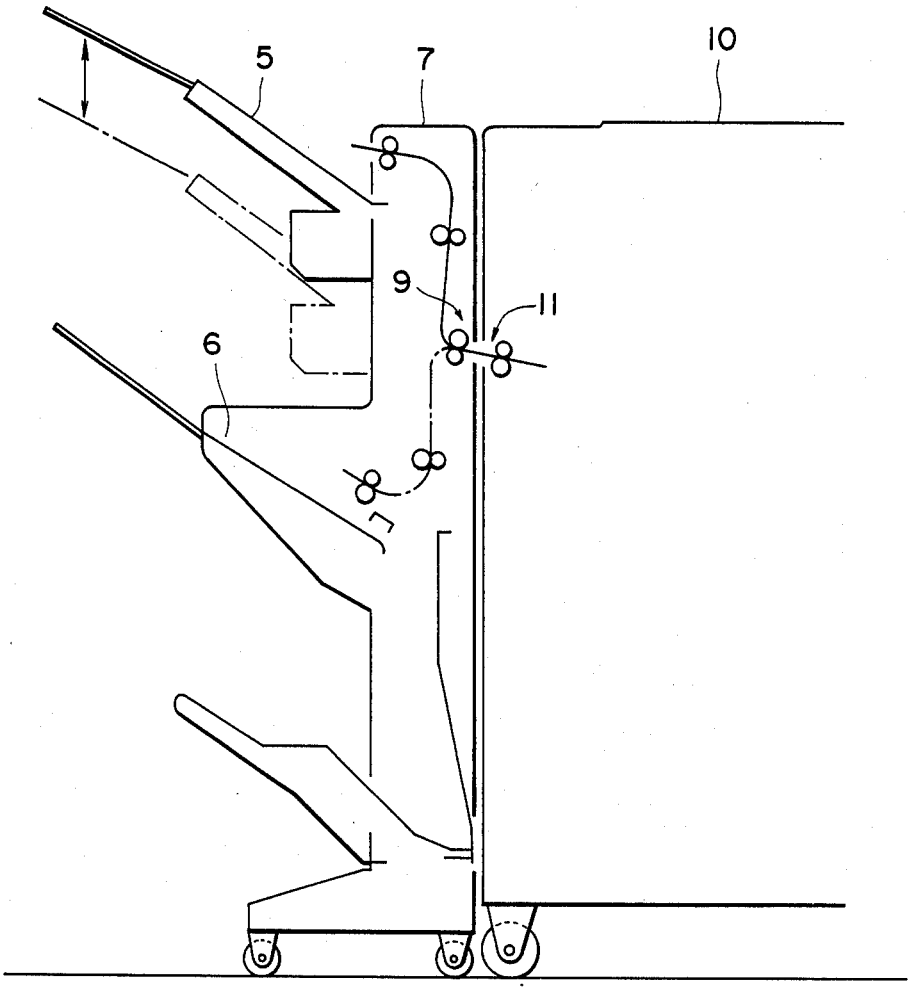
FIG. 9 is a sectional view of the finisher apparatus which alone is coupled to the image forming apparatus.

As shown in FIG. 9, the finisher apparatus can be directly coupled to the copying apparatus 10 in the manner that the sheet receiving inlet 9 of the apparatus 7 is aligned with the sheet discharging outlet 11 of the copying apparatus.

Figure 10:
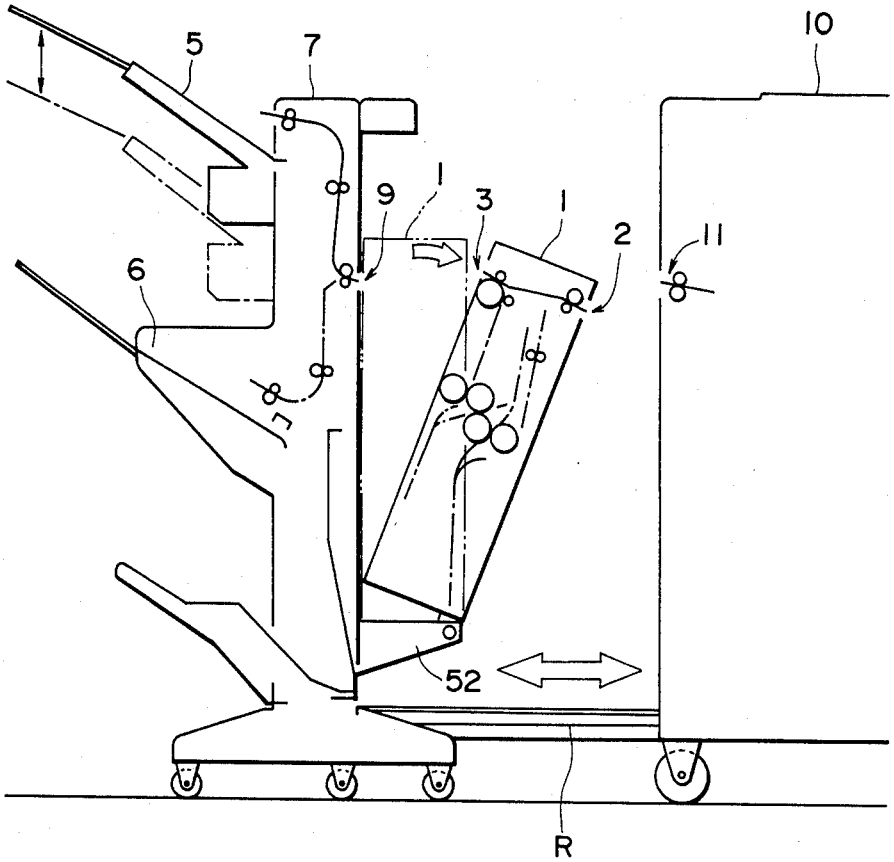
FIG. 10 is a sectional view of the sheet folding apparatus, the finisher apparatus and the image forming apparatus and illustrates the way of coupling them.

As shown in FIG. 10, when the folding apparatus 1 is coupled with the finisher apparatus 7, the lower side portions of the folding apparatus 1 is rotatably coupled to the leading portions of the bracket 52 mounted at the lower portion of the finisher apparatus, so that the folding apparatus 1 can be opened about the rotatably coupled pivot to dispose of the jam, when it occurs.

Since the folding apparatus according to this embodiment is of the structure as described above, when the folding apparatus 1 is connected to the copying machine 10, while the finisher apparatus 7 is connected to the folding apparatus, the folding apparatus 1 is rotatably supported on the finisher apparatus 7, and the finisher apparatus 7 is disposed in series with the copying apparatus 10 along a rail R so that the discharging outlet 11 of the copying apparatus 10 is aligned with the sheet receiving inlet 2 of the folding apparatus 1, as shown in FIG. 8.

The folded sheet S discharged through the discharging outlet 11 of the copying apparatus 10 is conveyed from the inlet 2 to the inlet deflector 15 by the rotation of the receiving couple of rollers 13 and 13. When a through-pass mode is selected wherein the sheet S is not subjected to any folding operation, the inlet deflector 15 selects the passing passage 16 so that the sheet S is transported through the passage 16 and is discharged to the discharge outlet 3 by the discharging roller couple 19.

As shown in FIG. 5, when a two-folding mode, z-folding mode or a reversed z-folding mode is selected, the inlet deflector 15 selects the passage 17, so that the sheet S is directed to the passage 17. The sheet S is conveyed through the passage 17 and is conveyed to a first deflector 12 by the rotation of the first folding roller 20. When a half size sheet (smaller than A4 or B5 (Japanese Industrial Standard)) is conveyed in the sheet folding mode, the first deflector 22 selects the first stage folding roller couple (20, 21); the second deflector 26 selects the second stage folding roller couple (21, 29); and the third deflector 31 selects the third stage folding roller couple (29, 33). Then, the sheet S passes through the first stage folding roller couple (20, 21), the second stage folding roller couple (21, 29) and the third stage folding roller couple (29, 33) and through the additional passage 36, and finally is discharged through the sheet discharging outlet 3 by the rotation of the discharging roller couple 19.

Figures 3A, 3B:
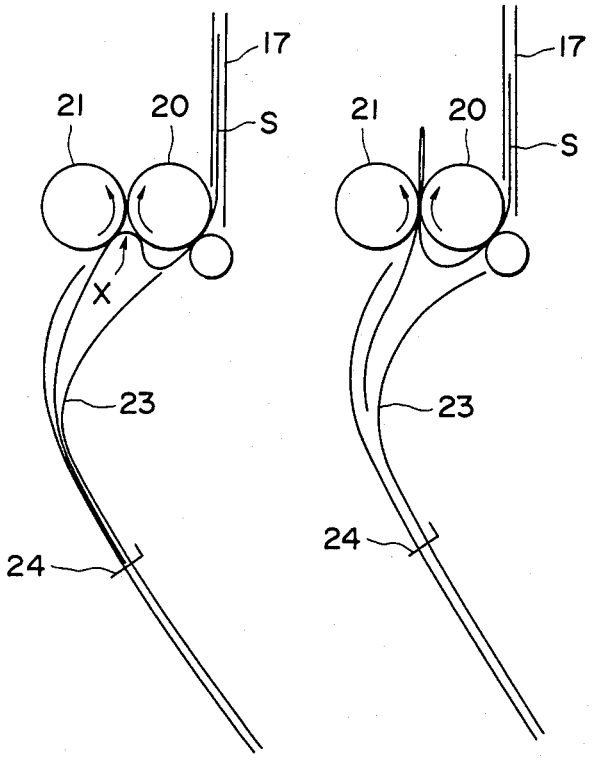
FIGS. 3A and 3B illustrate the process of folding the sheet by a couple of rollers.
Figure 5A:
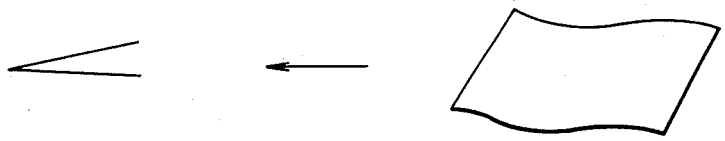
FIGS. 5A, 5B and 5C illustrates the manners of the two-folding, z-folding and a reversed z-folding.

As shown in FIG. 5A, when the two-folding mode is selected, the first deflector 22 selects the first folding position controlling passage 23, so that the sheet S is conveyed to the first folding position controlling passage 23 to such an extent that the leading edge of the sheet S abuts the fixed stopper 24. At this time, the solenoid 25*a* for driving the movable stopper 25 is not energized, and therefore, the movable stopper 25 is retracted from the folding position controlling passage 23. When the leading edge of the sheet S abuts the fixed stopper 24, a loop X is formed in the middle of the sheet S as shown in FIG. 3A. Then, the loop X of the sheet S is gripped by the nip of the first stage folding roller couple (20, 21) with the result that a fold is formed in the middle of the sheet S. The thus two-folded sheet S is guided by the second deflector 26 directed to the second stage folding roller couple (21, 29) and by the third deflector 31 directed to the third stage folding roller couple (29, 33), so that the sheet S is conveyed through the second stage folding roller couple (21, 29), the third stage folding roller couple (29, 33) and through the additional passage 36. Then, the sheet S is discharged through the outlet 3 by the rotation of the discharging roller couple 19.

Figure 5B:
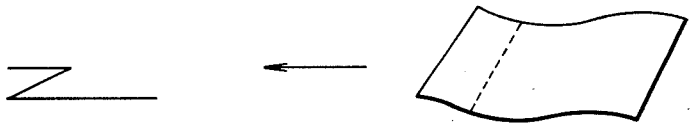

As shown in FIG. 5B, when the z-folding mode is selected, the first deflector 22 is switched to the first folding position controlling circuit 23, and the solenoid 25*a* is energized, and therefore, the movable stopper 25 is in the folding position controlling passage 23. The sheet S is guided by the first deflector 22 and is conveyed through the first folding position controlling passage 23 until the leading edge of the sheet S is stopped by the movable stopper 24. Then, a loop is formed adjacent a portion of one fourth of the length of the sheet S from the leading edge thereof. The loop of the sheet S thus formed is gripped by the first stage folding roller couple (20, 21), whereby a first fold is formed at a position of one fourth of the sheet S. The sheet S now having the first fold is guided by the second deflector 26 switched to the second folding position controlling passage 27 and is transported through the second folding position controlling passage 27 until the leading edge of the sheet S is stopped by the fixed stopper 30.

Figure 12:
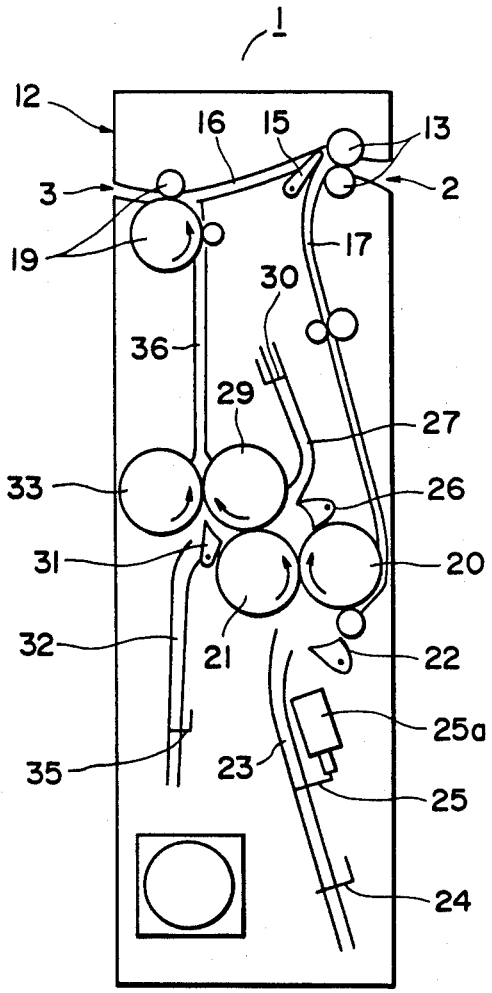
FIG. 12 is a sectional view of a sheet folding apparatus according to the present invention wherein the state of each of the deflectors is shown when the sheet is folded in the Z-fashion.

FIG. 12 shows the state of each of the deflectors when the z-folding mode is selected.

As shown in FIG. 6, a loop B is formed adjacent the edge of the sheet S having the first fold A. The loop B of the sheet S is gripped by the second stage folding roller couple (21, 29). At this time, due to the transportation of the sheet S, the topmost sheet surface D is contacted to the guiding member 28 so that the conveying force applied to the surface D is restrained, whereby the topmost sheet surface D and the intermediate sheet surface E are conveyed at the same linear speed. Because of this, no slack is produced in the intermediate sheet portion E of the sheet S. With no slack, the sheet S already having the first fold A is transported through the second stage folding roller couple (21, 29), and the second fold B is formed at a portion adjacent to the folded edge of the sheet S to provide a z-folded sheet. Then, the sheet S is guided by the third deflector 31 switched to the third stage folding roller couple (29, 33), and is transported by the third stage folding roller couple (29, 33) and through the additional passage 36. Subsequently, it is discharged through the outlet 3 by the rotation of the discharging roller couple 19.

In this embodiment, the guiding member 28 is mounted to the upper passage plate 27*a* of the second folding position controlling passage 27, but it is a possible alternative that the upper plate 27*a* is extended to the neighborhood of the nip formed between the second stage folding rollers 21 and 29.

Figure 5C:
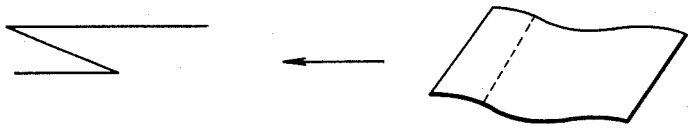
Figure 7:
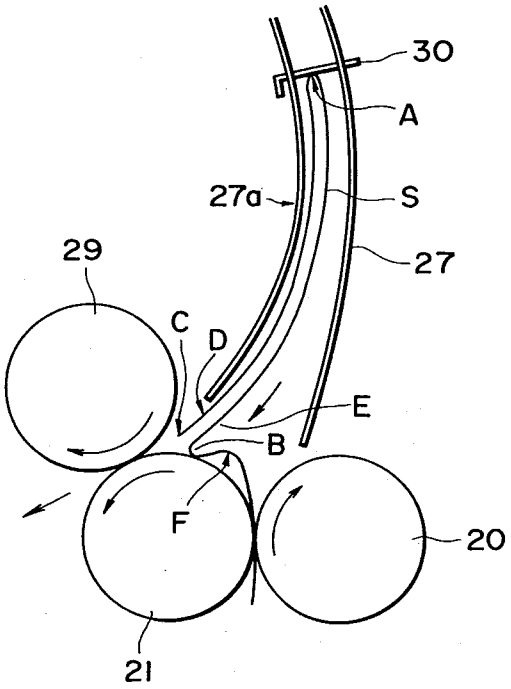
FIG. 7 illustrates the sheet folding mechanism of a conventional apparatus.

As shown in FIG. 5C, the reversed z-folding mode is selected, the first deflector 22 selects the first stage folding roller couple (20, 21); the second deflector 26 selects the second folding position controling circuit 27. Therefore, the sheet S is conveyed to the second folding position controlling passage 27 by the deflectors 22 and 26 and the first stage folding roller couple (20, 21), until the leading edge of the sheet S is stopped by the fixed stopper 30. Then, the sheet is further conveyed so that a loop is formed at a position adjacent to one fourth of the sheet S from the leading edge thereof. The loop of the sheet S is gripped by the nip of the second stage folding roller couple (21, 29), so that a first fold is formed at the position of one fourth of the sheet S. It should be noted that the direction of folding is opposite to the above-described case of the z-folding mode. The sheet S having the first fold is guided by the third deflector 31 switched to the third folding position controlling passage 32, and is conveyed to the third folding position controlling passage 32. The leading edge of the sheet S abuts the fixed stopper 35. When the sheet S is further conveyed, a loop is formed adjacent to the folded edge of the sheet S. The loop of the sheet S is gripped by the nip of the third stage folding roller couple (29, 33). Thus, the second fold is formed adjacent the first-folded edge of the sheet S. It should be noted that at the second fold, the sheet is folded in the opposite orientation to the case of the z-folding mode, thus providing a reversed z-folded sheet. The sheet S is transported through the additional passage 36 and is then discharged through the outlet 3 by rotation of the discharging roller couple 19.

The sheet S discharged through the outlet 3 of the folding apparatus 1 in the manners described above, is conveyed to the inlet deflector 43 from the inlet 9 by rotation of the receiving roller couple 42. When a stacking mode is selected wherein the sheet S is stacked on the sheet stacking tray 5*a*, the inlet deflector 43 selects the stacker passage 45, whereby the sheet S is transported therethrough and is discharged onto the tray 5*a* by rotation of the discharging roller couple 47. At this time, the sheet stacking tray 5*a* is moved in the horizontal direction, if necessary, so that the discharged sheets S are classified. The sheet stacking tray 5*a* is lowered in accordance with the amount of the stacked sheets S on the tray 5*a* so as to maintain a substantially constant and predetermined height through which the sheet S falls from the discharging roller couple 47 to the topmost sheet S on the stacking tray 5*a*.

When a stapling mode is selected wherein the sheets are stacked and stapled, the inlet deflector 47 is switched to the stapling passage 46, whereby the sheet is conveyed therethrough. The sheet S is discharged onto the intermediate tray 6a by the rotation of the dischraging roller couple 49 and rotation of the belt 50. The sheet S thus discharged is moved by the bottom portion of the belt 50 so that the trailing edges of the sheets S are aligned along the stopper 40. When a predetermined number of the sheets S are stacked and aligned on the intermediate tray 6a, the end portions thereof are stapled by the stapler 51. The stopper 40 is then pivotted so as to allow the stapled sheets S to fall to the lower tray 41.

Figure 11:
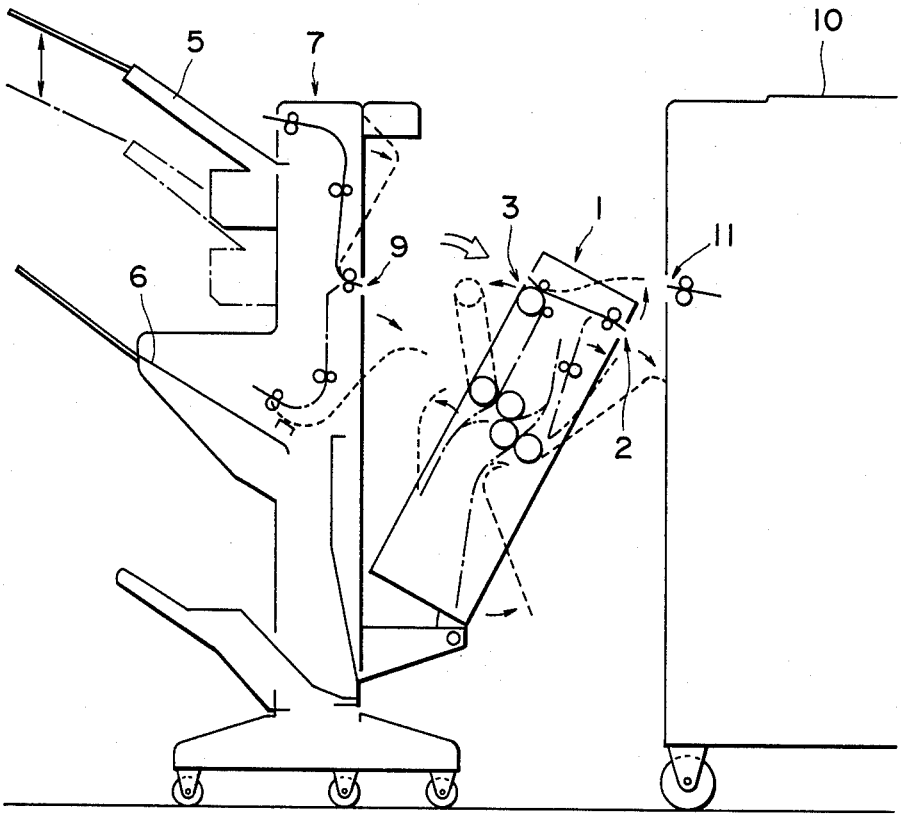
FIG. 11 illustrates a manner of jam disposal when the sheet folding apparatus is coupled to the image forming apparatus together with the finisher apparatus.

When the copying apparatus 10, the folding apparatus 1 and the finisher apparatus 7 are coupled in series as shown in FIG. 11, the finisher apparatus 7 and the folding apparatus 1 are separated from the copying apparatus 10 upon occurrence of jamming in the folding apparatus 1 or in the finisher apparatus 7. Further, the folding apparatus 1 is pivotted with respect to the finisher apparatus 7. And, various parts are opened to dispose of the jamming in the folding apparatus 1 or the finisher apparatus 7.

As described in the foregoing, according to the present invention, the sheet folding apparatus itself has a plurality of sheet conveying direction switching means, and by switching those means, the sheet is conveyed to different sheet folding roller couples, whereby it can perform various kinds of sheet folding operations. Therefore, one sheet folding apparatus is sufficient to effect two-folding, z-folding and a reversed z-folding or the like to the sheet discharged from an image forming apparatus such as a copying machine. Therefore, it is not necessary to couple a desired folding apparatus to the image forming apparatus depending on the folding fashions.

Further, according to the above-described embodiment of the present invention, the guiding member 28 is disposed adjacent the nip of the folding roller couple (21, 29), so that the contact of the sheet surface D to the roller 29 at a position other than the nip is minimized. Because of this, the sheet conveying force applied to the sheet surface D is suppressed by the contact of the sheet to the guide member 28, with the result that even when a three-folded sheet is transported through the folding roller couple (21, 29), the topmost sheet surface D and the intermediate sheet surface E are conveyed substantially at the same linear speed. Therefore, no noxious slack is produced in the intermdiate portion of the sheet E, so that occurrence of two lines of folds at cross positions even when a sheet already having a first fold is folded again.

While the invention has been described with reference to the structures disclosed herein, it is not confined to the details set forth and this application is intended to cover such modifications or changes as may come within the purposes of the improvements or the scope of the following claims.

What is claimed is:

1. A sheet folding apparatus, comprising:

an inlet for receiving a sheet material from outside of the sheet folding apparatus;

an outlet for discharging the sheet material to outside of the sheet folding apparatus;

a sheet material processing station for processing the sheet material, the processing station being disposed along a path of sheet material movement between said inlet and said outlet and including a plurality of sheet processing units each having a couple of folding rollers, a deflector and a folding position controlling passage;

a first passage for communicatng said inlet with said sheet processing station;

a second passage for communicating said sheet processing station with said outlet;

a third passage for directly communicating said inlet and said outlet; and an inlet deflector for selectively directing the sheet material received by said inlet to said first passage or to said third passage.

2. An apparatus according to claim 1, wherein adjacent two of said folding position controlling passages are disposed in said sheet material processing station at opposite sides of a sheet passage extending from said first passage to said second passage.

3. An apparatus according to claim 1, wherein adjacent two of said folding roller couple shared one of their rollers.

4. An apparatus according to claim 1, wherein the number of said sheet processing units is three.

5. An apparatus according to claim 1, wherein said sheet material processing station is below said third passage.

6. An apparatus according to claim 1, wherein said folding position controlling passage is provided with a stopper for stopping a leading edge of the sheet.

7. An apparatus according to claim 1, wherein said folding position controlling passage is provided with a plurality of stoppers, at least one of said stoppers being movable to change its stop position.

8. An apparatus according to claim 1, further comprising means for accommodating the sheet discharged through said outlet after passing through said second and third passages.

* * * * *